United States Patent [19]

Wouch et al.

[11] Patent Number: 4,817,527

[45] Date of Patent: Apr. 4, 1989

[54] PRINTING BLANKET WITH CARRIER PLATE AND METHOD OF ASSEMBLY

[75] Inventors: Gerald L. Wouch, Naperville; Gary Procknow, Chicago, both of Ill.

[73] Assignee: R.R. Donnelley & Sons Company, Lisle, Ill.

[21] Appl. No.: 836,766

[22] Filed: Mar. 6, 1986

[51] Int. Cl.[4] ..... B41F 27/02

[52] U.S. Cl. ..... 101/389.1; 101/415.1; 101/426; 428/909

[58] Field of Search ..... 101/415.1, 382 MU, 350, 101/426, 148, 458; 428/909

[56] References Cited

U.S. PATENT DOCUMENTS

| | | | |
|---|---|---|---|
| 2,752,280 | 6/1956 | Cooke et al. | 428/909 X |
| 2,774,302 | 12/1956 | Strömme | 101/378 |
| 2,982,207 | 5/1961 | Strömme | 101/395 |
| 3,180,259 | 4/1965 | McKay | 101/378 |
| 3,347,162 | 10/1967 | Braznell et al. | 101/376 |
| 3,509,819 | 5/1970 | Conole | 101/378 |
| 3,616,145 | 10/1971 | Clifton | 101/382 MU X |
| 3,668,752 | 8/1972 | Clifton et al. | 101/382 MU X |
| 3,730,092 | 5/1973 | Pickard et al. | 101/415.1 |
| 3,745,626 | 7/1973 | Bray | 101/382 MU X |
| 3,820,460 | 6/1974 | McElreath | 101/382 MU |
| 3,824,927 | 7/1974 | Pugh et al. | 101/378 |
| 3,885,497 | 5/1975 | Jenkins | 101/382 MU |
| 3,885,498 | 5/1975 | Jenkins | 101/382 MU |
| 4,015,046 | 3/1977 | Pinkston et al. | 428/909 X |
| 4,040,351 | 8/1977 | Faust | 101/382 MU |
| 4,078,031 | 3/1978 | Bishop | 101/382 MU X |
| 4,144,108 | 3/1979 | Gidley et al. | 101/382 MU X |
| 4,452,143 | 6/1984 | Heinemann et al. | 101/426 |
| 4,453,463 | 6/1984 | Dahlgren et al. | 101/350 X |
| 4,471,011 | 9/1984 | Spöring | 428/909 X |
| 4,510,868 | 4/1985 | Fischer | 101/382 MU |
| 4,577,560 | 3/1986 | Banike | 101/415.1 |
| 4,625,928 | 12/1986 | Peekna | 101/415.1 X |

*Primary Examiner*—Edgar S. Burr
*Assistant Examiner*—Moshe I. Cohen
*Attorney, Agent, or Firm*—Wood, Dalton, Phillips, Mason & Rowe

[57] ABSTRACT

A blanket for offset lithographic printing is bonded to a carrier plate for use in a press with magnetic cylinders.

8 Claims, 1 Drawing Sheet

FIG. 1
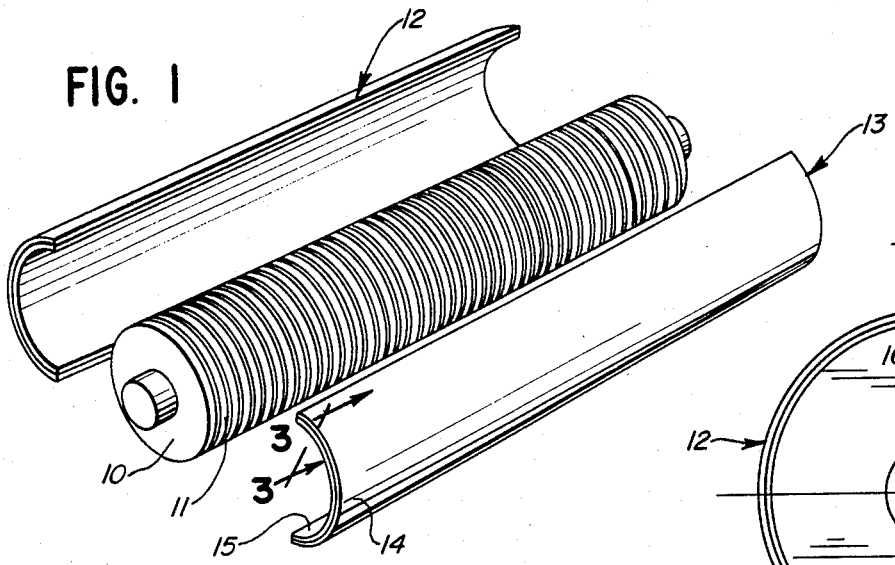
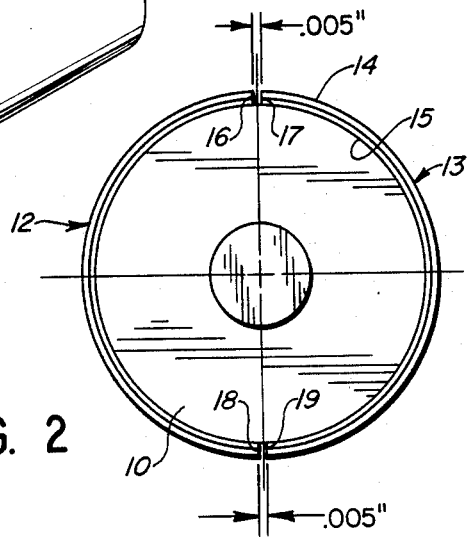
FIG. 2
FIG. 3
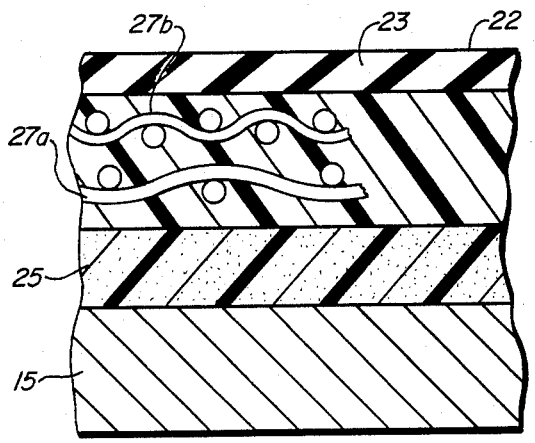
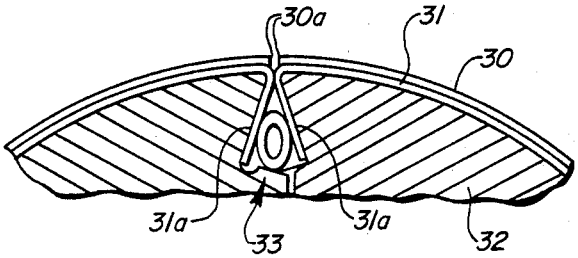
FIG. 5
FIG. 4
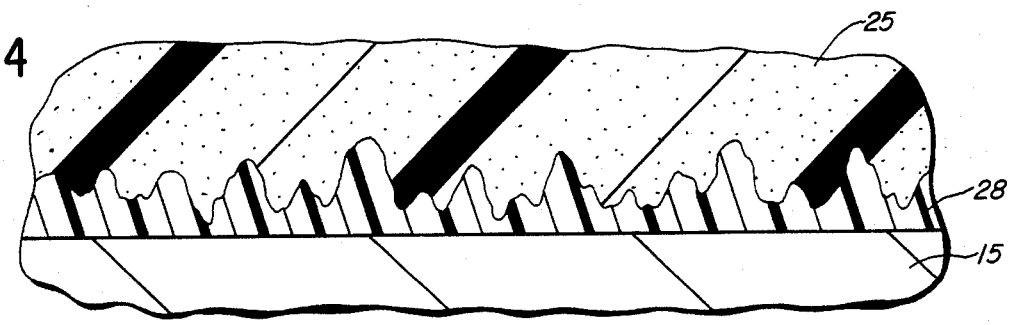

PRINTING BLANKET WITH CARRIER PLATE AND METHOD OF ASSEMBLY

This invention relates to a blanket for offset lithographic printing and more particularly to a blanket and carrier plate for web offset printing and to a method of assembling the blanket with the carrier plate. The blanket may have a ferromagnetic carrier plate for use in a press with magnetic cylinders, or a nonmagnetic carrier plate for use with a cylinder having a mechanical lockup mechanism.

BACKGROUND OF THE INVENTION

In offset printing an image is transferred from an inked plate to a blanket having an elastomer printing surface, and from the blanket to the paper being imprinted. Typically, an offset printing blanket has an elastomer body with one or more layers of fabric reinforcing and a fabric backing. The blanket is stretched around a cylinder and the ends are secured by a locking mechanism located in a longitudinal gap in the cylinder surface. Due to the planographic nature of offset printing, high pressure is required between the blanket and the plate or paper to insure transfer of the ink image. The discontinuity of the cylinder gap causes problems in high speed web printing, affecting the quality of the printed product and the design and maintenance of the press. For example, cylinders typically have bearer rings which minimize impact and vibration attributable to the locking mechanism gap, but which require a substantial mechanical load, introducing bearing and wear problems. Moreover, the gap leaves an unprinted area on the paper web, resulting in paper waste.

A magnetic gapless cylinder for web offset presses is shown in Peekna application Ser. No. 736,062 filed May 20, 1985, now U.S. Pat. No. 4,625,928, and Peekna et al. U.S. application Ser. No. 763,128, filed Aug. 6, 1985, now Pat. No. 4,676,161 assigned to R. R. Donnelley & Sons Company. This application discloses and claims a printing blanket on a carrier plate of ferromagnetic material suitable for use with the Peekna cylinder in web offset printing, and a method of assembling the blanket. Banike U.S. application, Ser. No. 642,080, filed Aug. 20, 1984, and assigned to R. R. Donnelley & Sons Company, now U.S. Pat. No. 4,577,560, discloses a gapless lockup mechanism for a plate cylinder. A blanket mounted on a plate can be used with a cylinder which has the Banike lockup mechanism.

Adhesive coated "sticky back" blankets which mount directly on a cylinder are used in offset form printing. The adhesive is dissolved by fountain solution and the "sticky back" blankets are not suitable for web offset printing. Others have mounted an elastomeric printing sheet on a steel plate, but not for the severe physical and chemical environment to which a blanket is subjected in offset web printing. For example, Faust U.S. Pat. No. 4,040,351 shows a rubber printing mat cemented to a steel base of shim stock, mounted on a magnetic cylinder, in a flexographic labeler or addresser. McKay U.S. Pat. No. 3,180,259 shows a molded rubber printing plate cemented to a steel base plate held on a magnetic printing wheel as used in a coding or dating machine. Jenkins U.S. Pat. Nos. 3,885,497 and 3,885,498 show molded magnetic cylinders, on which printing plates are mounted, and methods for molding the bases. Stromme U.S. Pat. No. 2,982,207 has a flexible printing plate secured, as by bonding, to a corrugated plate.

None of these blankets or resilient plates is subjected to the pressures, speeds or chemical exposure of web offset printing.

SUMMARY OF THE INVENTION

The printing blanket and carrier plate disclosed herein are usable with the severe physical and chemical environment of web offset printing.

One feature of the invention is an offset printing blanket used on a cylinder having a magnetic surface, in an offset web press, comprising an elastomer blanket sheet secured by an adhesive to a carrier plate of corrosion resistant ferromagnetic material. More particularly, the carrier plate is a ferritic stainless steel.

Another feature is that the blanket sheet has a printing surface and a base layer, which may be fabric reinforced. The based layer is a resilient closed cell foamed elastomer. The closed cell material prevents a structural adhesive, as an epoxy, from impregnating the blanket base and destroying its resilience, and minimizes the opportunity for blanket wash and fountain solution to attack the adhesive bond between the blanket and plate.

A further feature is the method of assembling the printing blanket and carrier plate including the steps of providing an elastomer blanket sheet having a printing surface and a closed cell base layer, providing a carrier plate of corrosion resistant ferromagnetic material, applying adhesive to at least one of the surface of the base layer or carrier plate and adhering the surface of the base layer of the elastomer blanket sheet to the carrier plate.

Yet another feature of the assembling method, in which the carrier plate is stainless steel, is the inclusion of a step of roughening the surface of the plate before adhering the elastomer blanket sheet thereto, as by hand sanding.

And a further feature of the assembling method is a step of cleaning the surface of the base layer of the elastomer blanket sheet, as by washing with acetone, before adhering the sheet to the carrier plate.

Further features and advantages of the invention will readily be apparent from the following specification and from the drawings, in which:

FIG. 1 is an exploded perspective illustrating a magnetic cylinder with printing blankets;

FIG. 2 is an end view of the cylinder of FIG. 1 with the printing blankets mounted thereon;

FIG. 3 is an enlarged fragmentary section through the blanket and carrier plate;

FIG. 4 is an enlarged fragmentary section of a portion of the base layer of the blanket sheet, the surface of the stainless steel carrier plate and the adhesive bond therebetween; and FIG. 5 is a fragmentary section illustrating a blanket and carrier plate mounted on a cylinder with a gapless lockup mechanism.

A blanket cylinder 10, FIGS. 1 and 2, for an offset web press has a magnet and pole piece surface structure 11 of the character disclosed in Peekna et al. U.S. Pat. No. 4,676,161.

Two identical 180° blanket and carrier plate assemblies 12, 13 are curved to fit on the cylinder. Each assembly has a printing blanket 14, an elastomer sheet secured to a ferromagnetic carrier plate 15, removably mountable on the cylinder. The magnetic structure of the cylinder forms no part of the present invention and is not illustrated or described in detail. A two-around blanket construction is illustrated for printing two pages with each rotation of the blanket cylinder. Other configurations, as four-around with each blanket subtending 90° of the cylinder, are possible. In a typical press, a two-around blanket cylinder has a diameter of 7.5 inches and length of 40 inches. The longitudinal gaps between adjacent edges 16, 17 and 18, 19 of the two blanket assemblies 12, 13 are of the order of 0.005 inch or less.

The elastomer blanket sheet 14 is made up of multiple layers as shown in FIG. 3. The printing surface 22 is provided by a layer 23 of nitrile rubber, as Buna-N. The printing surface transfers ink from an image carrying plate (not shown) to a paper web (not shown). The nitrile rubber layer 23 which has the printing surface 22 cannot be secured directly to the steel carrier plate 15 as the rubber with a rigid support would not withstand the physical stresses encountered in web offset printing. A composite structure is necessary to provide additional strength. A suitable blanket, as illustrated in FIG. 3, has a base layer 25 of closed cell foamed elastomer and an intermediate layer 26 with a woven reinforcing material impregnated with closed cell foamed elastomer. Two layers *27a*, *27b* of woven reinforcing material are shown. The inner layer *27a* is of cotton and nylon fibres and is relatively coarse. The outer layer *27b* is of cotton and polyester fibres and is a finer weave. One layer or more than two layers might be used. Typically, the outer layer of reinforcing fabric has a finer weave when more than one reinforcing layer is used. If appearance of the coarse weave image on the printed web is a problem with a blanket having a single reinforcing layer, a blanket with multiple layer reinforcing should be used. The three layers 23, 25, 26 are bonded together in the manufacture of the blanket sheet. The illustrated blanket is a Vulcan type 714 from Reeves Brothers, Inc. The Vulcan 714 blanket is sold commercially with a pressure sensitive adhesive on the base layer 25 and is mounted directly on the cylinder of a press for printing business forms. The blanket is provided by Reeves Brothers, Inc. without adhesive for use in accordance with the present invention.

The closed cell structure of the foam preferably has a cell size between 10 and 25 microns. Foam material with smaller cell size is stronger. Closed cells restrict migration of fountain solution and blanket wash which may attack the adhesive bond to the carrier plate and cause blanket deterioration. In addition, the closed cells prevent the adhesive from penetrating the foam. This is particularly important when a structural epoxy is used as epoxy in the foam destroys the foam resilience and shortens the blanket life.

The closed cell foam elastomer of base layer 25 may alternatively be a polysulfide or an epichlorohydrin material.

The base layer 25 of the blanket is adhesively secured to the surface of the steel plate at the interface 28. A structural epoxy adhesive, H. G. Fuller FE-7007, has been found satisfactory.

Offset blankets for web printing generally have a fabric backing of one or more layers or plys which provides mechanical strength to allow the blanket to be stretched around the cylinder. A fabric backed blanket cannot be adhered to a plate with a structural adhesive if the adhesive impregnates the fabric and solidifies, destroying the resiliency of the blanket. The absence of the fabric backing contributes to a longer blanket life as the backing is the most likely blanket component to fail in the event of a smash. Alternatively, a blanket with fabric backing which either is not impregnated by the adhesive or is so thin relative to the blanket that the blanket resiliency is not impaired may be used.

The nature of the bond between the blanket 14 and steel plate 15 is illustrated in FIG. 4. The under surface of the blanket base layer 25 is very irregular as compared with the surface of the steel plate 15. The valleys of the blanket surface are filled with the structural epoxy material forming a bonding interface 28. Voids which would contribute to a structural deficiency in the bond and which would permit press room chemicals to enter and attack the bond are filled with epoxy. The application and curing of the epoxy adhesive are described in more detail in Peekna et al. Ser. No. 123,192 filed Nov. 19, 1987 and assigned to R. R. Donnelley & Sons Company.

Before applying the epoxy adhesive and adhering the blanket 14 to the carrier plate 15, surfaces of both the blanket and the carrier plate are prepared so that the bond between the blanket and plate is more reliable.

The blanket base surface is paper finished and has a talc coating. This coating must be removed before applying the adhesive. The preferred procedure is to wash the blanket surface with acetone, taking care to minimize the time during which the rubber is exposed to acetone. Excessive acetone contact with the rubber causes the rubber to become tacky.

The surface of the carrier plate is roughened as by sanding. Chemical etching does not roughen the surface sufficiently to achieve a reliable bond. Sandblasting removed excessive metal and the temperature resulting from sandblasting relieved residual stresses in the carrier plate, causing warping. Accordingly, it is preferred to sand the carrier plate, in a flat configuration, with a fine abrasive, as a paper designated "K622-FINE-5725", from Norton Company. The paper is used in a hand manipulated power sander. Following sanding the carrier plate is curved to fit the cylinder before the blanket is adhered thereto.

Many of the advantages of the gapless blanket described above can be achieved without a magnetic cylinder by mounting the blanket on a carrier plate and securing the carrier plate to a cylinder with a minimal gap lockup mechanism. FIG. 5 illustrates a blanket 30 with a carrier plate 31 on a cylinder 32 with the lockup mechanism 33 of Banike U.S. Ser. No. 642,080 now U.S. Pat. No. 4,577,560. The blanket 30 is secured to carrier plate 31 utilizing a suitable adhesive as an epoxy. The plate 31 may, for example, be aluminum or stainless steel so that it will not corrode. The plate ends 31*a* are formed inwardly and engaged by the lockup mechanism. The nonprint gap 30*a* has a width of the order of 0.060 inch for an aluminum plate 0.012 inch thick or 0.030 inch for a steel plate 0.005 inch thick.

We claim:

1. An offset printing blanket for use in a web offset press, comprising:

a carrier plate of corrosion resistant material, said material being a ferritic stainless steel;

an elastomer blanket sheet which has a layer with a printing surface and a base layer of resilient, closed cell, foamed elastomer adjacent the carrier plate;

and an epoxy adhesive securing the blanket sheet to the plate.

2. The printing blanket of claim 1 in which said base layer is a chloroprene rubber.

3. The printing blanket of claim 1 in which said base layer is a polysulfide material.

4. The printing blanket of claim 1 in which said base layer is an epichlorohydrin material.

5. The printing blanket of claim 1 in which said layer with a printing surface is a nitrile rubber.

6. The printing blanket of claim 5 in which said nitrile rubber is a Buna-N rubber.

7. The method of assembling a printing blanket and carrier plate for use on a cylinder in a web offset press, including the steps of:

providing an elastomer blanket sheet having a printing surface and a closed cell base layer;

providing a carrier plate of corrosion resistant ferritic stainless steel;

roughening the surface of the plate;

applying epoxy to one of the base layer or the roughened surface of the carrier plate and adhering the base layer of the elastomer blanket sheet to the roughened surface of the carrier plate.

8. The assembly method of claim 7 in which said carrier plate surface is roughened by hand sanding.

* * * * *